United States Patent [19]

Isern

[11] Patent Number: 4,813,220

[45] Date of Patent: Mar. 21, 1989

[54] METHOD AND APPARATUS FOR SPLICING TEXTILE YARNS

[76] Inventor: Carlos P. Isern, C. Santalo, 148, 08021 Barcelona, Spain

[21] Appl. No.: 61,539

[22] Filed: Jun. 11, 1987

[30] Foreign Application Priority Data

Jun. 11, 1986 [ES] Spain ..... 555928
May 18, 1987 [ES] Spain ..... 8701457

[51] Int. Cl.[4] ..... D01H 15/00
[52] U.S. Cl. ..... 57/72
[58] Field of Search ..... 57/22, 261, 263

[56] References Cited

U.S. PATENT DOCUMENTS

| | | | |
|---|---|---|---|
| 4,406,115 | 9/1983 | Negaty-Hindi et al. | 57/22 |
| 4,407,117 | 10/1983 | Garnsworthy | 57/22 |
| 4,445,318 | 5/1984 | Becker et al. | 57/22 |
| 4,494,367 | 1/1985 | Badiali | 57/22 |
| 4,499,715 | 2/1985 | Chardon et al. | 57/22 |
| 4,539,802 | 9/1985 | Bertoli et al. | 57/261 X |
| 4,637,205 | 1/1987 | Badiali et al. | 57/22 |
| 4,720,966 | 1/1988 | Speranzin et al. | 57/22 |

*Primary Examiner*—Donald Watkins
*Attorney, Agent, or Firm*—Steinberg & Raskin

[57] ABSTRACT

Method and apparatus for splicing two textile yarn ends by untwisting the end portions of each to form a spread beard thereof, interpenetrating or intertwining the beards at both ends, and letting the twist accumulated at both ends progress towards the two mutually interwined or interpenetrated beards.

In the method, the untwisted end portions of both yarns are subjected to an axial traction force to set the beards of both yarn ends free and to separate and set the beard fibers substantially parallel with one another, while the beard bases are secured to retain the individual torsion or twist of the fibers, with the beards then being moved laterally to arrange the same adjacent to one another at zones of the beard bases, while the beards are simultaneously slided in longitudinal relative movement to one another.

In the apparatus according to the invention, yarn holding nips are axially movable, while beard support members have two complementary surfaces are movable about rotation axes and along paths from outer positions regarding the yarns, to positions in which the complementary surfaces are mutually adjacent. The apparatus comprises as well, holding members for the ends of the beards retained by the revolving nips, to preserve the twist thereof.

In a pneumatic embodiment, the twisting and untwisting of the yarn is accomplished by pneumatic chambers of substantially circular cross-section, and with a longitudinal gap for placing the yarn therein, along with a pair of tangentially-communicating ducts entering the chamber at diametrically opposed positions so that pressurized air injected alternately and in opposite directions through these ducts and into the chamber, generate within the chamber a swirl that causes the coaxially-arranged yarn therein to revolve in one direction for being twisted and in the opposite direction for becoming untwisted.

18 Claims, 5 Drawing Sheets

METHOD AND APPARATUS FOR SPLICING TEXTILE YARNS

BACKGROUND OF THE INVENTION

The present invention is directed to a method for splicing two textile yarns, and to apparatus for performing this method.

Methods for splicing two textile yarns are known in which a beard is formed on each yarn end to be spliced by untwisting a portion of this end, with the beard fibers being mutually separated at zones or areas of the beard bases, and the separated fibers of both ends being mutually superimposed by arranging the fiber ends of one beard at the beard base of the opposite beard and intertwining or interpenetrating the fibers of both beards, with yarn torsion being simultaneously transferred to the mutually interpenetrated or intertwined fibers from both ends of each beard.

EP Pat. No. 81-29,808 has previously suggested splicing textile yarns by forming a beard on both yarn ends to be spliced with the beard bases being in spaced apart relation, then placing one beard upon the other in a plane and with the ends of one beard facing the base of the other beard respectively, and then making the fiber ends of the respective beards penetrate between the separated fibers at the adjacent bases of the other beard. When a yarn twist is reinserted in the beards, the thus-arranged fibers reassume the original conditions of the spun yarn, appreciably unchanged, in appearance or in mechanical strength of the yarn.

The method according to this patent requires a comparatively complex mechanism for forming the beard on a flat surface and carrying out the interpenetration or intertwining of the end fibers at the respective spaced-apart zones of the adjacent beards. In fact, this method requires for forming the beards, a mechanical device for forming the beard itself, a mechanical device for untwisting the yarn, pneumatic, electrostatic, and thermal devices for extending the fibers in a plane and separating the same at the base zones for individuating the fibers, as well as forcing the beard fibers to mutually separate away thus providing a combing effect, and air injection ducts which are transversely directed in the plane of the beards. Other devices are also used, such as a device for suctioning through the beard-supporting platen to accommodate or support the beard, or a device for applying hot air for enhancing the fiber plasticity.

Furthermore, when pneumatic, thermal, or electrostatic devices are resorted to, consistency of results is not thoroughly controllable and partially depends on the nature of the yarns to be spliced. In fact, due to the nature of the yarn, the pneumatic, electrostatic and thermal devices do not always result in obtaining beards showing the same features or characteristics.

U.S. Pat. No. 4,244,169 and EP Pat. No. 53,093 are variations of EP Pat. No. 81-29,808. Use is made of ultrasound in EP Pat. No. 53,093 for individuating the fibers.

Other documents describe particular devices for untwisting the yarns, such as applications EP Pat. No. 39,609; EP Pat. No. 78,776; EP Pat. No. 123,329; EP Pat. No. 134,764; EP Pat. No. 78,777; EP Pat. No. 78,778; EP Pat. No. 120,523; and EP Pat. No. 140,412, in which the yarn is untwisted by making it roll between two surfaces moving in opposite directions. These surfaces are basically formed of discs movable at an angle.

Pneumatic devices for imparting a twist to a yarn, either in the spinning process or in the course of the yarn splicing operations, are also well known.

Swiss patent specification No. 495,445 describes a method for joining two yarn ends by means of a pneumatic chamber, in which the two yarn ends are inserted and mutually adhere under a twist imparted by the pressurized air spinning or revolving within the chamber in a single direction.

German patent specifications Nos. 2,750,913 and 2,854,514 describe a method for joining two spun textile yarns by means of a device having a turbulence chamber causing a twist effect to take place, when each yarn end is wound about the other end.

In the above methods and devices, both yarn ends are inserted in the pneumatic chamber in superimposed condition.

In the spinning method called "Open End", use is made of two chambers, each one of which causes pressurized air rotation in opposite directions.

While the results obtained with the method generally described above are indeed good, the means used for carrying out the same into practice give rise to problems and lead to comparatively costly and complex solutions.

SUMMARY OF THE INVENTION

Accordingly, it is an object of the present invention to solve, at least in part, the drawbacks of the above-noted solutions.

It is also an object of the present invention to improve the splicing of textile yarns.

It is another object of the present invention to improve control in splicing of textile yarns.

It is a further object of the present invention to increase the reliability in textile yarn splicing.

It is still another object of the present invention to simplify the splicing of textile yarns.

It is yet a further object of the present invention to reduce costs and expenditures involved in textile yarn splicing.

These and other objects are attained by the present invention which is directed to a method for splicing two textile yarns, by first untwisting fibers of an end region of a first one of the yarns to form a first beard having a base and an end region thereof, and untwisting fibers of an end region of a second one of the yarns to form a second beard having a base and an end region thereof, the beards being substantially situated in a common plane, with an axial traction force being applied to each beard to mutually separate both beards, to mutually separate the beard fibers and set the same substantially parallel to one another and by applying holding forces to the end regions of each respective beard to hold each beard substantially stationary and retain individual twist of the fibers. The first and second beards are superimposed by applying opposite moving forces to respective beards to position a zone contiguous the end region of the first beard at a zone contiguous the base of the second beard, and a zone contiguous the end region of the second beard at a zone contiguous the base of the first beard. The respective beards are substantially simultaneously slided in opposite longitudinal directions with respect to each other, to intertwine or interpenetrate the fibers of the respective beards from both ends thereof.

The present invention is also directed to apparatus for splicing two textile yarns, which comprises a pair of retaining nips for retaining ends of the respective yarns in substantially stationary position, and a pair of revolving nips for receiving the respective yarns, winding the respective yarns thereabout, and untwisting the same to form beards. The retaining nips each are movably mounted for movement along a substantially axial direction of the retained yarns.

A pair of support members are also provided for supporting the respective beards of the yarns. The support members have complementary surfaces and are movably mounted about respective centers of rotation for movement between respective inner and outer positions. The complementary surfaces are adjacent one another at the inner positions thereof. A pair of holding members is provided for holding ends of the beards retained by the respective revolving nips to maintain the beards in substantially stationary position and preserve twist of the individual untwisted fibers of the respective beards.

With the above objects under consideration, the subject of the present invention is a method for splicing the ends of two textile yarns, in which each yarn is subjected, after it has been untwisted, to an axial traction or pulling force to cause mutual separation of two beards and placing the fibers thereof substantially parallel. A force is applied onto a zone of the yarn beard end to hold the beard substantially stationary and preserve the individual twist of the yarns. Thereafter, lateral forces moving in opposite directions are applied within a plane in which the two yarns are arranged, at a zone contiguous to the ends of the beards, to situate these zones adjacent to the base of the opposite beard, thereby forcing one beard against the other while simultaneously causing opposite longitudinal sliding motion of one beard with respect to the other.

The twist of the superimposed beards, the fibers of which are mutually intertwined, is progressively transmitted from both ends towards a center thereof. Propagation of this twist is determined by applying transverse, mutually opposite and movable forces on the beards, with such progression of twisting following towards the center from the ends when the forces are removed.

A further object of the present invention is apparatus for performing the above method which comprises nips for holding or retaining the ends of the respective yarns, in addition to revolving nips for both holding the yarns and twirling or rolling the latter to thus untwist the twisted yarn and form beards. Support means for supporting the respective beards and being movable to contact the beards with one another are also provided. The respective yarn end-holding nips are axially movable.

The supporting means or support members for the beards comprise two complementary surfaces which are movable about a rotation center according to two paths, i.e. from respective outer positions regarding the yarns, up to inner positions in which the complementary surfaces are adjacent one another. The apparatus of the invention also comprises holding members for retaining the ends of the beards which are retained by the revolving nips, in order to retain the beard ends substantially stationary, and to maintain the individual twists of the fibers constituting the beards.

Other constructive features of the apparatus in accordance with the present invention will be described in greater detail below.

Among the other features of the present invention, a controlled relative motion between the fibers is made easier by subjecting the yarn to divergent forces in a transverse plane, while at the same time pressing and making the fibers of the respective ends of the adjacent beards slide with respect to one another.

Due to the apparatus which is the subject of the invention herein, the yarn is untwisted by a revolving nip and subjected to a slight traction effect by an axially movable traction nip having the effect of setting the fibers substantially parallel by means of a relative displacement of the beards.

Furthermore, a holding member presses onto the beard and retains the individual twists of the fibers, so that when superimposing of the beards takes place, the individual twists with which the fibers were originally arranged in the yarn is recovered with an effect similar to twisting, in which every fiber is imparted with a twist allowing preservation of the yarn ensemble in stabilized condition. This twisting effect would not be present if the fibers of he beard ends were subjected to the conventional combing effect.

In a pneumatic operating version of the present invention, each revolving nip is replaced with a single pneumatic chamber which causes, on each of the yarns to be spliced, rotation in both directions to accomplish the above-described untwisting and twisting effect on each yarn.

According to this pneumatic embodiment, the means for untwisting and twisting of the yarn are constituted by pneumatic chambers of substantially circular cross-section, in which a pair of ducts are arranged in diametrically opposite positions to impinge on the chamber interior in tangential directions. Pressurized gas, e.g. air, is injected through these ducts alternately and in opposite directions. The pressurized air brings about a swirling effect within each chamber, which makes the coaxially-disposed yarn therein revolve in one direction for twisting, and in the opposite direction for untwisting.

Additionally, the above-described pneumatic chambers each comprise a longitudinal gap for inserting and removing of the yarn.

By means of the above-described chambers, untwisting and twisting of the yarn is attained in a manner which is equivalent to the operation of the above-described revolving nips.

BRIEF DESCRIPTION OF THE DRAWINGS

For a better understanding of the present invention, reference is made to the following description below taken in conjunction with the accompanying drawings, in which.

DESCRIPTION OF THE PREFERRED EMBODIMENTS

Figure 1:
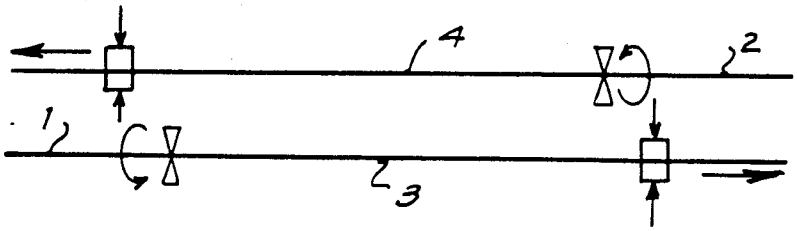
FIGS. 1–4 are schematic illustrations showing different phases of the method for splicing two textile yarns in accordance with the present invention.

FIG. 1 illustrates a first step in the method of the invention, in which the previously-untwisted yarns 1,2 are subjected to axial traction or pulling forces A for causing mutual separation of both beards 3,4, as well as fiber separation and setting of the same substantially parallel.

Figure 2:
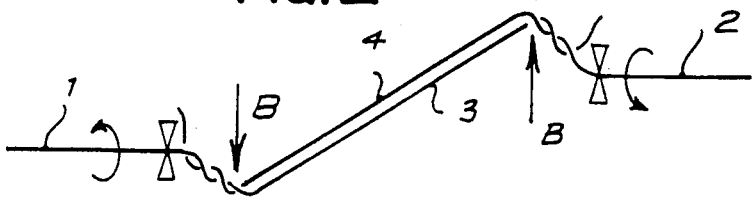

Afterwards, the zone of the beard ends is subjected to forces to retain the beards substantially stationary and preserve the individual twists of the fibers. Thereafter, as illustrated in FIG. 2, lateral movable and opposite forces B are applied in a plane comprising both the yarns 1,2, in a zone contiguous to the ends of the beards 3,4, to thereby arrange the beard ends adjacent the base of the opposite beard. One beard is pressed against the other while simultaneously causing longitudinal and opposite sliding motion of one beard with respect to the other.

Figure 3:
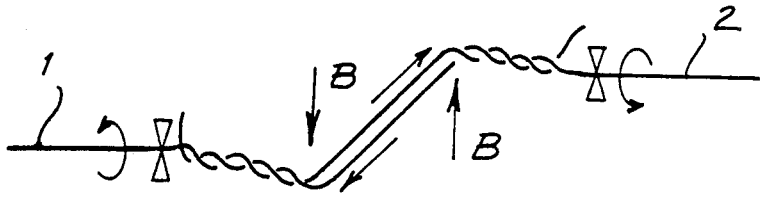
Figure 4:
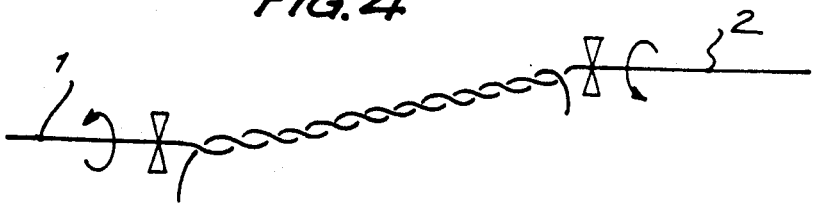

As illustrated in FIG. 3, the twist of the superimposed beards 3,4, having mutually intertwined fibers is progressively transmitted from both ends towards a center thereof, the propagation of this torsion being bound or determined by subjecting the beards 3,4 to the transverse, opposite forces B which are movable towards the center. Finally, when these forces B are removed, the entire twist is transmitted as may be seen in FIG. 4.

Figure 5:
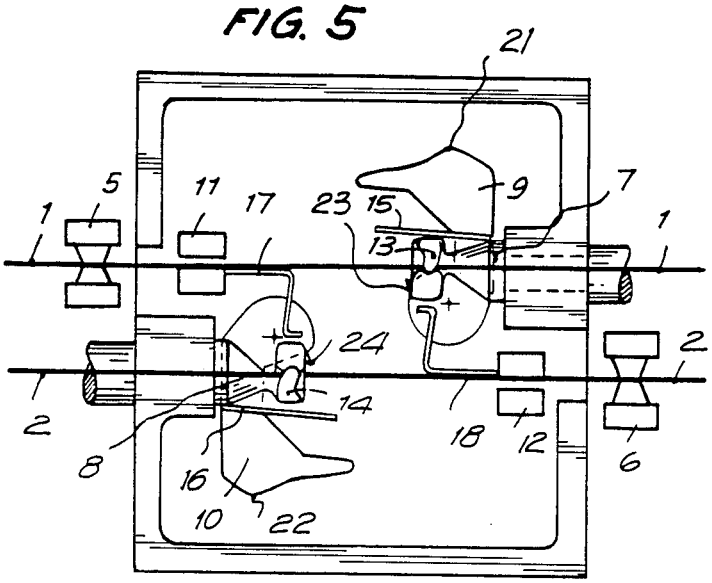
FIGS. 5–9 are top plan views of apparatus in accordance with the present invention, illustrating several positions of the members or components thereof in the successive method phases or steps.

As seen in FIG. 5, the apparatus for splicing the yarns 1,2 comprises retaining or holding nips 5,6 for the ends of the yarns, revolving nips 7,8 and support members 9,10 for the respective beards.

The device also comprises holding or retaining members 11,12 for the ends of the beards retained by the revolving nips 7,8.

In FIG. 5, the two yarns to be spliced are arranged substantially parallel with one another in the apparatus, with the ends thereof being retained by the holding nips 5,6. In the position illustrated in FIG. 5, the holding members 11,12 are in open condition, with the yarns passing through the same.

Figure 6:
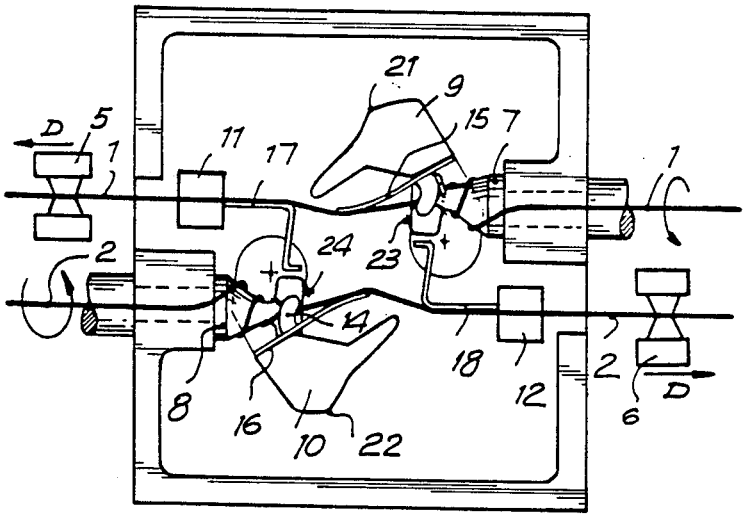

In FIG. 6 the revolving nips 7,8 for holding the yarns 1,2 wind a portion of the yarns, thus untwisting such a portion.

Figure 10:
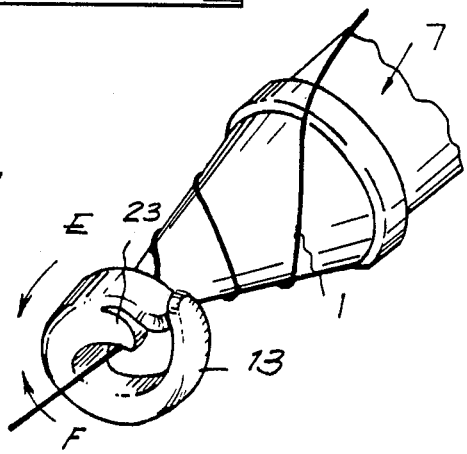
FIG. 10 is a perspective view, in enlarged detail, of a revolving nip of the apparatus of the present invention.

FIG. 10 illustrates one of the revolving holding nips 7 comprising, at a forward end thereof, a spiraled finger 13, which, when revolving in the direction indicated by arrow E, draws the yarn 1,2 towards the rotation axis, while when rotating in the direction indicated by arrow F, moves away from the yarn. The respective holding nip 7,8 also comprise a respective protruding finger 23,24 at the front part thereof, for causing separation of the fibers at the ends of the beards 3,4 guided by two raised portions 21,22 of the main body of supporting member 9,10, and causing winding of the thus-separated fibers about the opposite beard at the zone which is immediate or adjacent the revolving, holding nip 7,8 as illustrated.

Figure 8:
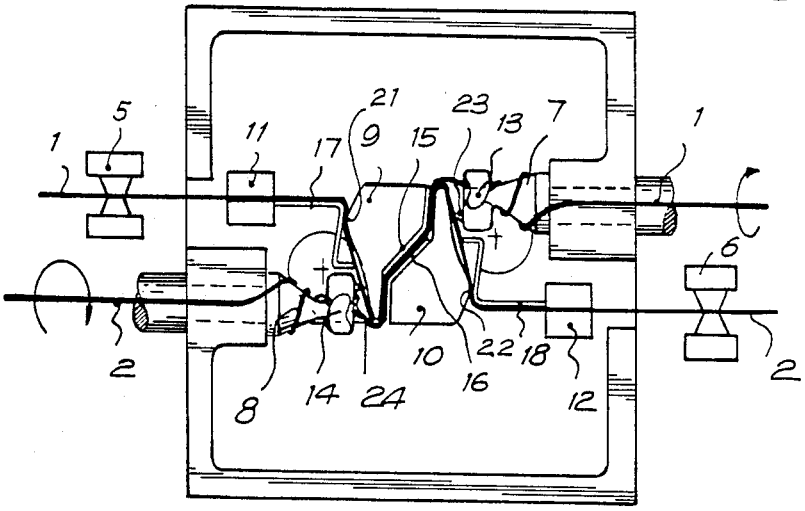

As illustrated in FIG. 6, the holding nips 5,6 for the ends of yarns 1,2 move axially in the direction of arrows D, thus causing sliding between the fibers of the beards and an initial combing at the untwisted yarn portion. At the same time, the holding members 11,12 push the beard ends, thus preserving the individual twist of the fibers. The supporting members 9,10 for the beards have two complementary surfaces and are movable about a center of rotation according to two paths, i.e. from respective outer positions regarding the yarns as illustrated in FIG. 5, up to an inner position in which the complementary surfaces are adjacent one another (FIG. 8). The surfaces of the beard support members 9,10 may be lined with an abraiding and elastic material. Either support member 9,10 for the beards 3,4 may also comprise lateral walls constituting, when the support members are mutually superimposed (i.e. at the inner positions thereof), a chamber into which pressurized gas, e.g. air, may be injected to cause a turbulence effect for enhancing mutual interconnection between the fibers of both beards 3,4.

Figure 7:
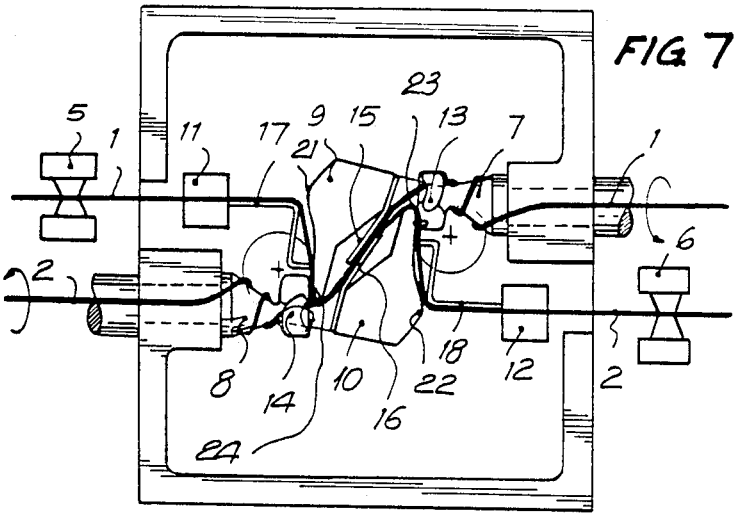

Furthermore, the support members 9,10 for the beards 3,4 may each comprise the main body provided at an end remote from the center of rotation thereof, with the raised portion 21,22 in turn formed with notches 19 for guiding and joining the beard ends. The main body also comprises an extended portion 15,16 secured at one end to the main body, and movable under the elasticity of the other end thereof regarding the main body, to thereby cause, upon displacement of the beard support members 9,10, seating of the complementary surfaces with one another and relative displacement of the same to provide friction and mutual interpenetration or intertwining of the beards 3,4. FIG. 7 illustrates the supporting members 9,10 closer to one another, and drawing therewith the beards 3,4 of yarn 1,2 laid onto the flexible extensions or straps 15,16 of the above support members, thus causing increase in the length of the untwisted yarns which are retained by the holding members 11,12, at the expense of the sliding taking place between the fibers and causing parallelism of the fibers, i.e. the fibers becoming substantially parallel with one another. The convex profile stops 17,18 enhance holding of the untwisted yarn fibers which are retained by the holding members 11,12. The fixed stops 17,18 are positioned to receive the outer raised portion 21,22 of the main body of each support member for the beards 3,4, at the instant of the support member superimposition (FIG. 8), to retain the ends of the beards 3,4.

Figure 11:
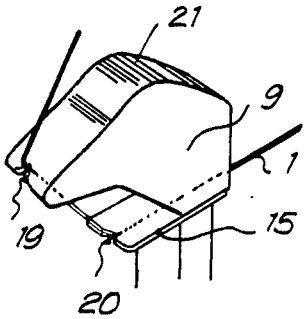
FIG. 11 is a perspective view, also in enlarged detail, of a beard-supporting member in accordance with the invention.

The yarns 1,2 are guided onto the support members 9,10 by means of guide notches 19,20 respectively formed at the ends of the support members and the corresponding flexible straps 15,16 as illustrated in FIG. 11 for the support member 9.

When the two support members 9,10 become superimposed as in the position illustrated in FIG. 8, friction between the contacting surfaces promotes interpenetration or intertwining of the beard fibers of both yarns. The surfaces of the flexible straps 15,16 are lined with rubber or similar material for enhancing seating of the beards and shredding of the opposite beard fibers.

When the support members 9,10 move from the position illustrated in FIG. 5 up to the position of FIG. 8, the support members 9,10 draw the yarn beards thus causing a development increase in each beard and exerting of a pressure onto the other retained beard.

The raised or rising portion 21,22 of the respective support member 9,10 rests on the convex profile stops 17,18, thus causing thorough retention of the beard 3,4.

When the holding, revolving nips 7,8 rotate in the direction indicated by the arrow F in FIG. 10, the finger 23,24 picks up the free end of the opposite beard and winds it up over the beard retained in the nip, thus starting the torsion recovering phase.

With further rotation of the nip 7,8, the twist recovery proceeds and, at the same time, the support members 9,10 move such that the hindrance which prevented the twist from running is gradually removed and thereby the twist is transmitted to the central zone or area.

Figure 9:
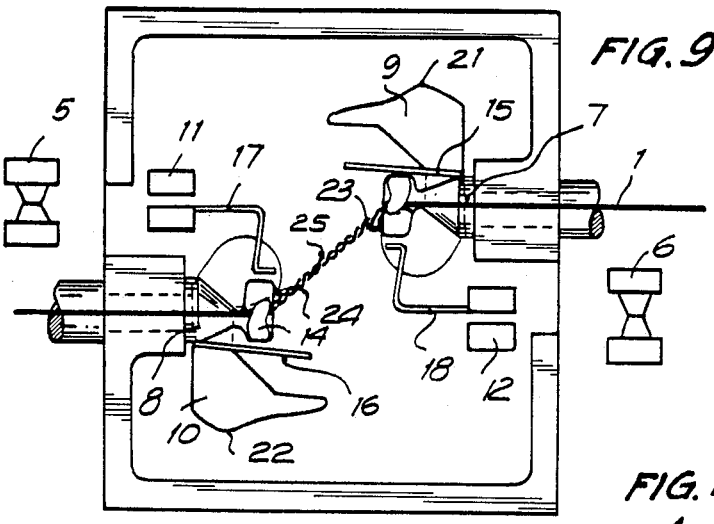

When the support members 9,10 reach their whole spacing, twist is transmitted to the entire beard and thus the splicing of the yarns takes place in the central zone 25 (FIG. 9). At the same time, the holding, revolving nips 7,8 release the yarn upon rotation of the spiral finger 13,14 in the opposite direction, with the apparatus of the invention thus reaching the position indicated in FIG. 9.

A pneumatic version of the revolving nips as described in the previous embodiment of FIGS. 1–11, will now be described with reference to FIGS. 12 and 13.

Figure 12:
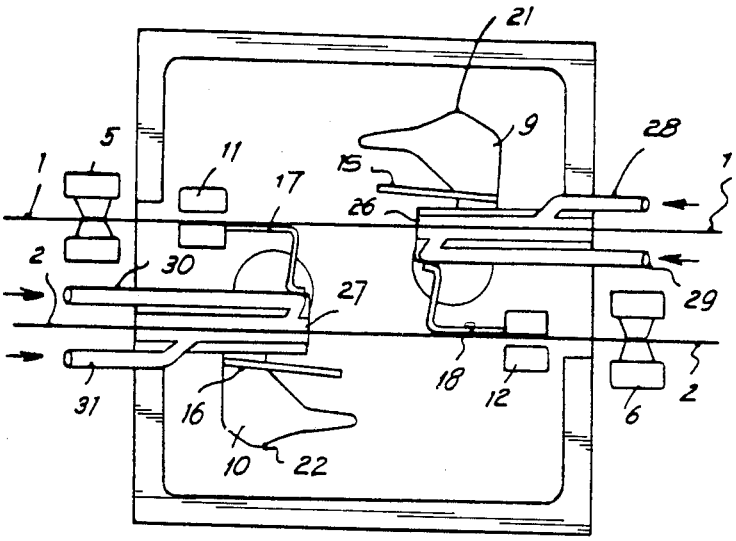
FIG. 12 is an upper plan view of apparatus for splicing two textile yarns as implemented with pneumatic swirling chambers instead of the revolving nips illustrated in the embodiment of FIGS. 5–11.

As seen in FIG. 12, the revolving nips 7,8 of the previous embodiment have been replaced with corresponding pneumatic chambers 26,27 of substantially circular interior cross-section, for untwisting and twisting the yarns 1,2.

A pair of ducts, indicated by reference numerals 28,29 and 30,31 respectively, communicate with the interior of chambers 26,27 at diametrially opposite positions, with pressurized gas, e.g. air, being injected therethrough alternately and in opposite directions to cause swirling gas or air movements to take place within these respective chambers 26,27. These gas or air swirls make the coaxially-arranged yarn revolve in one direction for twisting and in the opposite direction for untwisting.

The pneumatic chambers 27,28 each include a longitudinal gap 32 for inserting and withdrawing the yarn. FIG. 13 illustrates chamber 26 with the longitudinal gap 32.

When pressurized air is injected through duct 28, a swirl is created within the chamber 26 which provides for untwisting (or twisting) of yarn 1. When pressurized air is injected through duct 29, a swirl is generated within the chamber 26 in the opposite direction, which provides for twisting (or untwisting) of the yarn 1.

With the method and apparatus of the present invention, correct arrangement of the superimposed beards is attained, while cross-sectional increase related to mere superimposition, or at least the weak point due to floating fibers which are removed in the procedure, is avoided, with perfect smoothness of the resulting cross-section being thus attained.

At the same time, an exceedingly desirable quality of appearance is attained due to the fact that the previously-rejected twist is thoroughly replaced by the mutually superimposed, joined, and intertwined beards.

Due to the thus-attained, thoroughly controlled effects of superimposition and twist transmission, high reliability is obtained.

The method and apparatus of the present invention feature an easy consistency in preparation and assembling conditions of the beards, with this being a function of the specified shapes of the mechanisms or components described above, while the timing of operating sequences are dependent on gear mechanisms of the apparatus itself, rather than on a command member.

It is further important to note that the fibers are continuously subjected to tension that prevents the same from relaxing, with a controlled sliding taking place between the fibers of both beards.

Figure 13:
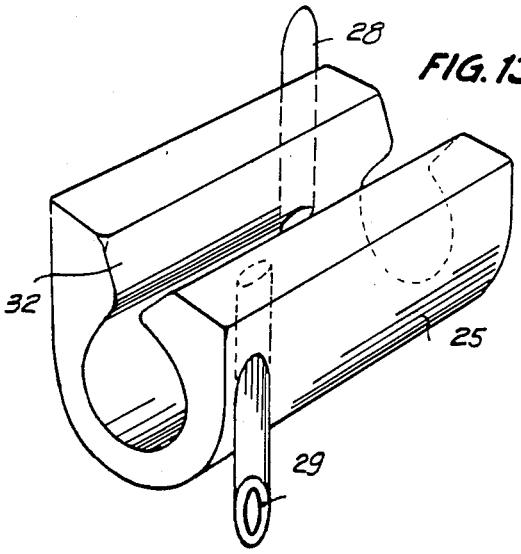
FIG. 13 is a perspective view of the pneumatic chamber of FIG. 12 for twisting and untwisting of the yarn.

The desired twisting and untwisting effect is obtained as well with the embodiment in which the revolving nips 7,8 have been replaced with the pneumatic chambers 23,24 according to the illustration in FIGS. 12 and 13, also encompassed within the scope of the present invention.

The preceding description of the present invention is merely exemplary, and is not intended to limit the scope thereof in any way, with feasible variations being understood as within the scope thereof.

What is claimed is:

1. Method for splicing two textile yarns, comprising the steps of first untwisting fibers of an end region of a first one of the yarns to form a first beard having a base and an end region thereof, and untwisting fibers of an end region of a second one of the yarns to form a second beard having a base and an end region thereof, the beards being substantially situated in a common plane, after untwisting the fibers in the respective end regions, applying an axial traction force to each beard to mutually separate both beards, and to mutually separate the beard fibers and set the same substantially parallel to one another, applying holding forces to the end region of each respective beard to hold each beard substantially stationary and retaining individual twist of the fibers, superimposing said first and second beards by applying opposite moving forces to respective beards to position a zone contiguous the end region of the first beard at a zone contiguous the base of the second beard, and a zone contiguous the end region of the second beard at a zone contiguous the base of the first beard, and substantially simultaneously sliding the respective beards in opposite longitudinal directions with respect to each other to intertwine the fibers of the respective beards from both ends thereof.

2. The method of claim 1, comprising the additional steps of stopping the application of the opposite forces, and causing the intertwining of the fibers to proceed from the opposite ends towards one another after the application of the opposite forces has stopped.

3. Apparatus for splicing two textile yarns, comprising a pair of retaining nips for retaining ends of the respective yarns in substantially stationary position, said nips each being movably mounted for movement along a substantially axial direction of the retained yarns, a pair of revolving nips for receiving the respective yarns, winding the respective yarns thereabout, and untwisting the same to form beards, a pair of support members, for supporting the respective beards of the yarns, said support members having complementary surfaces and being movably mounted about respective centers of rotation thereof for movement between respective inner and outer positions, said complementary surfaces being adjacent one another at said inner positions thereof, and a pair of holding members for holding ends of the beards retained by said respective revolving nips to maintain the beards in substantially stationary position and preserve twist of individual untwisted fibers of the respective beards.

4. The apparatus of claim 3, wherein each said support member comprises a main body, a raised portion provided on an end of said main body remote from the center of rotation thereof, a notch provided in said raised portion for guiding and joining of the beard ends of the yarn, an extension secured at one end thereof to said main body, said extension being elastically movable at the opposite end thereof and positioned such that upon displacement of said supporting members to said inner position, said complementary surfaces seat against one another and are displaced relative to one another to provide friction and mutual intertwining of the beards.

5. The apparatus of claim 4, wherein the complementary surfaces of said supporting members are lined with abrading and elastic material.

6. The apparatus of claim 4, wherein said support members each comprise laterally-extending walls formed around said respective complementary surfaces, and forming a chamber when said supporting members are at said inner position with said complementary surfaces being adjacent one another, and means for injecting pressurized gas into the thus-formed chamber for generating turbulence therewithin and enhancing mutual intertwining between the fibers of the beards.

7. The apparatus of claim 4, additionally comprising a pair of fixed stops, each positioned to receive said raised portion of a respective one of said supporting members when said members are positioned at said inner position and thereby retain the ends of the beards.

8. The apparatus of claim 7, wherein said stops are each convex-shaped facing said respective supporting member and are attached to respective holding members for the respective beard ends, and retain the beard end of the respective yarn between the same and said raised portion of said supporting member at said inner position thereof.

9. The apparatus of claim 4, additionally comprising a spiraled finger positioned on a forward end of each said revolving nips and shaped to bring the yarn towards a rotation axis of said revolving nip when said finger is rotated in one direction, and move the yarn away from the rotation axis when said finger is rotated in the opposite direction.

10. The apparatus of claim 9, additionally comprising a protruding finger at the forward end of each said revolving nip and positioned to separate fibers at the beard ends guided by the raised portions of said support members, and wind the same about the opposite beard at an adjacent zone to said revolving nip.

11. The apparatus of claim 9, additionally comprising a protruding finger at the forward end of each said revolving nip and positioned to pick up the end of the opposite beard and wind the opposite beard end over the beard retained in said respective nip, when said revolving nip is rotated in the opposite direction.

12. Apparatus for splicing two textile yarns, comprising a pair of retaining nips for retaining ends of the respective yarns in substantially stationary position, said nips each being movably mounted for movement along a substantially axial direction of the retained yarns, a pair of pneumatic chambers, each of substantially circular interior cross-section, a pair of ducts arranged on each said diametrically opposite positions and tangentially communicating with an interior of each said chamber, means for alternately injecting pressurized gas through said opposite ducts to thereby generate turbulence within said pneumatic chamber and cause the yarn substantially coaxially received in said chamber to revolve in one direction for twisting of the same, and in the opposite direction for untwisting of the same to form a beard, a pair of support members for supporting the respective beards, said support members having complementary surfaces and being movably mounted about respective centers of rotation thereof for movement between respective inner and outer positions, said complementary surfaces being adjacent one another at said inner positions thereof, and a pair of holding members for holding ends of the beards in substantially stationary position and preserving twist of individual untwisted fibers of the beards.

13. The apparatus of claim 12, additionally comprising a longitudinally-extending gap in each said chamber for inserting and withdrawing the yarn therethrough.

14. The apparatus of claim 4, additionally comprising a notch provided in the end of said extension opposite said main support body for guiding the beard end.

15. The apparatus of claim 4, wherein said extensions are each flexible straps.

16. The method of claim 1, wherein said oppositely-moving forces which are applied are laterally-directed forces which are applied within a plane in which the two yarns are arranged, and which move in the opposite longitudinal directions with respect to one another.

17. The method of claim 16, wherein said laterally-directed forces move towards one another.

18. The method of claim 1, wherein the fibers are intertwined by twist or torsion thereof, propagation of said twist or torsion is bounded by the opposite moving forces, and twist or torsion of the fibers is propagated from ends thereof towards centers between the ends and bases of the beards.

* * * * *